US012655512B2

(12) United States Patent
Niederstein

(10) Patent No.: US 12,655,512 B2
(45) Date of Patent: Jun. 16, 2026

(54) HIGH-TEMPERATURE GALVANIZING PROCESS FOR FERROUS MATERIAL PARTS

(71) Applicant: Coatinc PreGa GmbH & Co. KG, Kreuztal (DE)

(72) Inventor: Paul Niederstein, Kreuztal (DE)

(73) Assignee: Coatinc PreGa GmbH & Co. KG, Kreutzal (DE)

( * ) Notice: Subject to any disclaimer, the term of this patent is extended or adjusted under 35 U.S.C. 154(b) by 0 days.

(21) Appl. No.: 18/690,719

(22) PCT Filed: Sep. 9, 2022

(86) PCT No.: PCT/EP2022/075071
§ 371 (c)(1),
(2) Date: Mar. 8, 2024

(87) PCT Pub. No.: WO2023/036912
PCT Pub. Date: Mar. 16, 2023

(65) Prior Publication Data

US 2024/0376583 A1 Nov. 14, 2024

(30) Foreign Application Priority Data

Sep. 9, 2021 (DE) ..... 102021123320.8

(51) Int. Cl.
*C23C 2/06* (2006.01)
*C23C 2/00* (2006.01)

(52) U.S. Cl.
CPC ..... *C23C 2/06* (2013.01); *C23C 2/51* (2022.08); *C23C 2/521* (2022.08); *C23C 2/522* (2022.08)

(58) Field of Classification Search
CPC ..... C23C 2/06; C23C 2/50–522
See application file for complete search history.

(56) References Cited

U.S. PATENT DOCUMENTS

2009/0004400 A1* 1/2009 Ranjan ..... C23C 2/06 106/1.17
2010/0323095 A1* 12/2010 Barjon ..... C23C 2/0038 427/561

FOREIGN PATENT DOCUMENTS

CN 108796415 A 11/2018
DE 3734204 A1 4/1989
(Continued)

OTHER PUBLICATIONS

International Searching Authority, International Search Report and Written Opinion mailed on Nov. 25, 2022, issued in connection with International Application No. PCT/EP2022/075071, filed on Sep. 9, 2022, 12 pages.

(Continued)

*Primary Examiner* — James M Mellott
(74) *Attorney, Agent, or Firm* — Lee Sullivan Shea & Smith LLP

(57) ABSTRACT

The invention relates to a method for high-temperature galvanization of ferrous material parts (10). The method comprises the production of zinc melt (12). The method further comprises saturating the iron concentration of the zinc melt (12) so that it is iron-saturated. In addition, the method comprises producing an undersaturation of the iron concentration of the zinc melt (12) so that it is iron-undersaturated. The method further comprises dipping the ferrous material parts (10) in iron-undersaturated zinc melt (12), whereby a galvanization layer (14) is formed on the ferrous material parts (10).

20 Claims, 7 Drawing Sheets

(56) References Cited

FOREIGN PATENT DOCUMENTS

Figure 1:
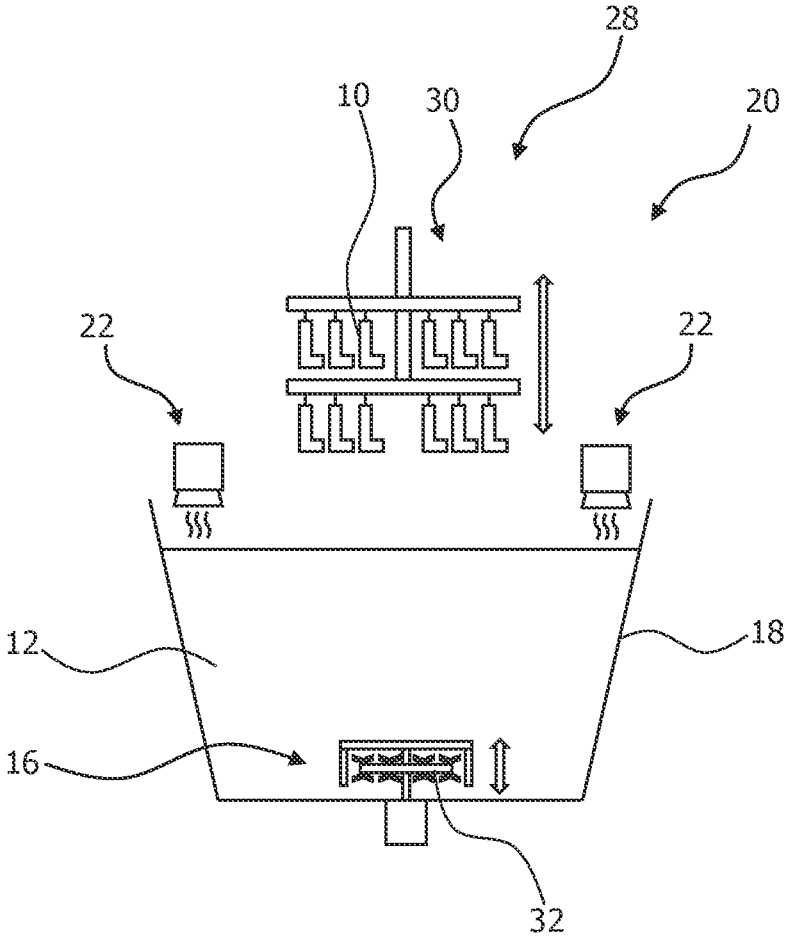

| | | | |
|---|---|---|---|
| DE | 3911060 | A1 | 10/1990 |
| DE | 4101011 | A1 | 7/1992 |
| JP | H04221050 | A | 8/1992 |

OTHER PUBLICATIONS

German Patent Office, German Examination Report and Translation mailed on Nov. 19, 2024, issued in connection with German Application No. 10-2021123320.8, 14 pages.
German Patent Office, German Search Report and Translation mailed on Apr. 13, 2022, issued in connection with German Application No. 10-2021123320.8, 16 pages.
International Preliminary Report On Patentability, PCT Application No. PCT/EP2022/075071, dated Sep. 26, 2023.

* cited by examiner

HIGH-TEMPERATURE GALVANIZING PROCESS FOR FERROUS MATERIAL PARTS

CROSS REFERENCE TO RELATED APPLICATIONS

This application is a national stage application under 35 U.S.C. § 371 of International Application No. PCT/NZ202/075071, filed Sep. 9, 2022, which claims the benefit of priority from German Application No. 10 2021 123 320.8, filed Sep. 9, 2021. The disclosures of all of the above applications are incorporated by reference herein in their entireties.

The invention relates to a method for high-temperature galvanization of ferrous material parts. The invention further relates to an associated galvanization line as well as to a corresponding control unit for such a galvanization line.

Ferrous materials, and steel in particular, are among the most important materials and are used as source material for components in a wide variety of technical areas. In many areas, it is necessary to protect ferrous material parts, i.e. parts made of a ferrous material such as steel or cast parts in particular, from corrosion. A galvanization layer is often used for this purpose, with which the ferrous material parts are coated or the component is given a zinc alloy layer in diffusion processes through the reaction with zinc. So-called hot-dip galvanization produces zinc melt into which the ferrous material parts that are to be protected are dipped after suitable pre-treatment. Thus, a galvanization layer is formed, which typically comprises different iron-zinc phases as well as pure zinc. The protective effect of the galvanization layer can be manifold, it is based on different reactions of the zinc, depending on the influence of the environment. On the one hand, a weather-resistant protective layer of zinc oxide and zinc carbonate forms on the surface of the galvanization layer when it is exposed to air. On the other hand, compared to iron zinc a base metal, i.e. its electropotential under standard conditions is more negative than that of iron. Zinc can therefore serve as a galvanic anode for iron. If the galvanization layer is locally damaged and the underlying iron is exposed, this leads to the oxidation of zinc instead of iron, as the elemental zinc can release electrons to temporarily formed iron ions, whereby the net value of elemental iron is retained while zinc ions are formed. The resulting zinc salts, such as zinc oxide and zinc carbonate, ideally fill the local damage, so that a certain self-healing effect, through which the originally exposed areas can be closed again, can be observed. In this case, the increase in volume of the zinc when fresh zinc reacts with water is a positive effect, as it closes these very areas.

Hot-dip galvanization is usually carried out in a zinc melt at a temperature of around 450° C. However, there are also methods in which significantly higher temperatures are used, in particular temperatures of at least 520° C. and more. This is known as so-called high-temperature galvanization. Due to the higher temperature, the zinc melt is significantly more fluid or less viscous when high-temperature galvanization is used. If the ferrous material parts that are to be coated are pulled out of the zinc melt, the liquid zinc flows off the ferrous material parts faster and more completely. This also largely prevents the accumulation of liquid zinc in narrow structures such as recesses, internal edges, small through-apertures, threads, etc., so that reworking of the galvanized ferrous material parts is, at most, only necessary to a lesser extent. The zinc remains liquid for longer and can flow from the component back into the zinc melt. This process can be supported, for example, by the use of shakers or compressed air lances. In so-called centrifugal systems, the excess zinc melt is removed by placing the components in a basket and centrifuging it. The zinc is spun off by the strong centrifugal forces. In addition to the advantageous zinc run-off properties, high-temperature galvanization is also characterized by the fact that layers that are not too thick but hard and correspondingly abrasion-and wear-resistant iron-zinc layers are formed. The undesirable, sometimes extreme growth in layer thickness in hot-dip galvanization at normal temperature is triggered by certain constellations of the alloy components of the ferrous material (primarily silicon and phosphorus), especially in the case of steel, which are less important in high-temperature hot-dip galvanization, as the iron-zinc phase formed in the hot-dip galvanization at normal temperature is liquid at temperatures above 520° C. and thus there is no additional zinc build-up.

All known hot-dip galvanization methods use iron-saturated zinc melt. Iron-saturation is often already achieved by using ferrous boilers and galvanizing ferrous components. Iron from the material of the boiler walls, which, for example, may be made of steel, migrates into the zinc melt until it is saturated with iron. If a galvanization boiler is used for several years, this effect slowly reduces its wall thickness, which is therefore checked at regular intervals. This loss of boiler material is accepted, as without it the zinc melt would attack the ferrous material parts even more. During galvanization, iron continuously migrates from the boiler wall and primarily from the components into the zinc melt. As a result, the molten mass becomes locally oversaturated and iron-zinc particles form in the molten mass. These are heavier than the molten mass and settle to the bottom. The resulting hardened zinc is regularly removed from the bottom using hard zinc grippers. Since the ferrous material parts that are to be galvanized contain iron themselves, they would be partially removed by non-ferrous zinc melt. Iron would migrate from the ferrous material parts into the zinc melt. It is only ensured in the iron-saturated molten mass that this decomposition of the ferrous material parts, and in particular that of the boiler, does not occur. The process is slowed down by the iron saturation.

In high-temperature galvanization, however, the saturation concentration of iron in the zinc melt is significantly higher due to the higher temperature, which is why boilers made of ferrous material cannot be used. To produce zinc melt that is suitable for high-temperature galvanization, the temperature range between 470° C. and 520° C. has to be passed through. In this range, the liquid zinc is so reactive that a steel boiler would already be damaged to a considerable extent while passing through the range. They would decompose in a comparatively short time period because the boiler would be more severely attacked than in the case of conventional hot-dip galvanization, which would make the operation of the facility uneconomical as the boilers would have to be replaced at short time intervals. For this reason, ceramic boilers are regularly used for high-temperature galvanization, as their material does not decompose in the zinc melt or does not decompose significantly. In order to prevent the ferrous material parts from decomposing within a short time period due to the higher saturation concentration of iron in the zinc melt mentioned, iron is added to the zinc melt during the initial preparation of the molten mass. In addition to the natural loss of iron from the ferrous material parts that are to be galvanized, this also occurs, for example, through the loss of iron from suspensions on crossbars, which are dipped into the molten mass together with the ferrous material parts suspended from them. Hard zinc can be intentionally added during the initial batch to obtain a basic iron content.

Therefore, the use of iron-saturated zinc melt is presently essential, regardless of the temperature of the molten mass.

Due to the iron content described, the zinc melt is already an alloy. Other metals, such as lead or bismuth, are regularly added in small quantities. Such additives for example reduce the surface tension of the molten mass, which improves the wetting with zinc and its run-off when the ferrous material parts are extracted. Other known additives include nickel, tin and aluminum.

In order to vary the thickness of the galvanized layer during high-temperature galvanization, the temperature of the molten mass and the dipping time can be altered according to known methods. In principle, short dipping times can lead to low layer thicknesses. However, controlling the layer thickness by changing the dipping time is only possible to a limited extent. First of all, during the usual dipping and extraction of ferrous material parts, i.e. in batch galvanization, the dipping time is not the same for all ferrous material parts. The lowest hanging ferrous material parts remain longer in the molten mass when dipping from above than ferrous material parts that hang right at the top. Longer components are also dipped at an angle, so that the dipping time for a single component can vary depending on its position on the crossbar. A certain minimum dipping time is also required to ensure that the temperature of the ferrous material parts can adjust completely to the temperature of the zinc melt during dipping.

In general, layer thickness control is thus only possible to a limited extent. Based on prior art, the present invention is providing a method for controlled high-temperature galvanization which permits good control of the properties of the galvanization layer produced, in particular with regard to its layer thickness.

According to the invention, this task is solved by a method having the features of claim 1. Further embodiments of the invention can be found in the dependent claims. According to the invention, a method for high-temperature galvanization, particularly with adjustable layer thicknesses of ferrous material parts, for example of parts made of a ferrous material such as cast parts and/or of steel parts, can comprise the production of zinc melt. The method can further include saturating the iron concentration of the zinc melt so that it is saturated with iron. The saturation may be achieved by adjusting the iron saturation in the molten mass. The method can, in particular after saturation, comprise generating an undersaturation of the iron concentration of the zinc melt so that it is undersaturated with iron. In addition, the method may comprise dipping the ferrous material parts into the iron-undersaturated zinc melt, whereby a galvanization layer is formed on the ferrous material parts. The ferrous material parts may be ferrous material parts that are to be galvanized, which are different from, for example, steel crossbars, drums or other parts made of steel and/or ferrous material that are temporarily in the zinc melt during the process, for example to serve as supports, hooks or containers, but whose galvanization is not the goal of the process.

The invention is based on the surprising finding that high-temperature galvanization can be controlled by deliberately undersaturating the zinc melt. Contrary to the widespread belief that the zinc melt must always be iron-saturated, it has been shown that the thickness of the galvanization layer can be specifically influenced during high-temperature galvanization in iron-undersaturated zinc melt. The reaction kinetics of the processes that lead to the decomposition of steel and other ferrous materials in uncontrolled unsaturated zinc melt, as described above, can be utilized in a targeted manner. The method according to the invention provides a previously unused parameter in the form of undersaturation, by means of which the thickness of the galvanization layer can be adjusted, in particular largely independently of the specific temperature of the zinc melt and dipping time used, as well as the material composition of the components.

According to the invention, use is made of the fact that two central processes take place in the zinc melt, the interaction of which influences the properties of the galvanization layer, provided that this is carried out at a suitable distance from the iron saturation concentration. On the one hand, iron that forms the growing galvanization layer is lost from the ferrous material parts. Various iron-zinc phases are formed in a known manner, such as an alpha phase, a delta-1 phase and a gamma phase. The zeta phase that occurs in regular hot-dip galvanization, however, does not occur in high-temperature galvanization. It is not solid at temperatures above 520° C. On the other hand, iron is lost from the galvanization layer, i.e. from the temporarily formed iron-zinc layer, into the zinc melt. This second process is primarily due to the difference in the iron concentration between the component and the zinc melt. The second process can take place because the zinc melt can still absorb iron due to its undersaturation. Thus, for a given specific undersaturation, at least an approximate equilibrium can be achieved in which the galvanization layer grows and decomposes at approximately the same rate. As a result, the aforementioned extensive independence from the dipping time can be achieved.

In other words, the undersaturation of the iron concentration of the zinc melt may be adjusted in such a way that after an initial formation of a galvanization layer on the ferrous material parts during dipping the ferrous material parts into zinc melt, a rate at which the galvanization layer grows and a rate at which the galvanization layer formed is removed are substantially equal. This may include that the two rates differ from each other by no more than 50%, in particular no more than 40%, in some cases no more than 30% and in some embodiments no more than 20%. This information may refers to the higher of the two rates. If the galvanization layer is produced in this way, a longer dipping time essentially only leads to a greater loss of iron from the ferrous material parts and/or a greater accumulation of hard zinc, the latter especially after the iron saturation concentration has been reached and exceeded again, which can lead to the loss of hard zinc. However, the loss of iron is so small that the actual properties of the component are not significantly affected.

It is understood that the zinc melt may include other components in addition to zinc and iron, such as lead, bismuth or aluminum. The term "zinc melt" can therefore refer to the process-related meaning rather than a purely chemical or physical meaning.

The method is particularly carried out on an industrial scale. The ferrous material parts can be large, but they can also be small. In particular, the zinc melt has a total mass of at least 10,000 kg, in many cases of at least 15,000 kg, and in some cases of at least 20,000 kg, although significantly larger masses or volumes are also possible according to the invention.

The undersaturation of the iron concentration can be at least 1%, in many cases at least 2%, in some cases at least 5% but also at least 10% or even more, relative to the saturation concentration. If the saturation concentration of iron in the zinc melt is 0.5 wt. % (percent by weight), for example, an undersaturation of 5% means that the actual iron concentration is 5% lower than the saturation concentration, which in the example provided would correspond to a concentration of iron in the zinc melt of 0.475 wt. %. The thickness of the galvanization layer can be controlled advantageously via the degree of undersaturation. At least in a range of slight undersaturation, the relation can be such that a higher degree of undersaturation leads to thinner galvanization layers, in particular essentially independent of the dipping time.

The undersaturation is preferably established starting from a fully saturated state of the zinc melt. This allows the undersaturation to take place in a controlled manner. The production of the undersaturation then involves that the zinc melt moves away from the iron saturation concentration. In principle, however, according to the invention, undersaturation can also be established, in particular in a controlled manner, starting from a completely and/or more strongly undersaturated state. In this case, the invention can include the saturation of the iron concentration of the zinc melt as a downstream method step or not at all. The system can also be reversed in that thicker layers can be produced in the case of oversaturation.

Producing the zinc melt involves melting zinc and, if necessary, melting other components of the zinc melt, which can be added in a targeted manner. In general, a boiler can be provided to hold the zinc melt. Preferably, the zinc melt is produced in a ceramic boiler. Other boiler materials can be used as an alternative or in addition, in particular those that contain little or no iron.

According to one embodiment of the invention, dipping the ferrous material parts comprises lowering them into the zinc melt, in particular into the boiler. After a predetermined dipping time has elapsed, the ferrous material parts can be pulled out of the zinc melt or the boiler again. Dipping and pulling them out, for example, are carried out vertically to a surface of the zinc melt. This can therefore be a batch galvanization process. The ferrous material parts can be suspended and/or attached to beams, such as suitable crossbars, for dipping and/or pulling them out, which can be moved into and/or out of the zinc melt. Depending on the nature of the ferrous material parts, drums or other containers into which the ferrous material parts are added before being dipped into the zinc melt can be used as well. This is suitable, for example, for small parts, but is not limited to it.

In other embodiments, the dipping may comprise a continuous movement of the ferrous material parts. This may involve moving the ferrous material parts through the zinc melt, whereby a dipping duration is determined by the time period that can be defined through the movement along a predetermined path of movement through the zinc melt. This may, for example, involve strip galvanization. Accordingly, the ferrous material parts can be sheet metal, for example in the form of a steel strip. Mixed forms may also be possible according to the invention, in which first a lowering into the zinc melt and then a movement in the zinc melt are carried out.

The zinc melt can have a temperature of at least 500° C., in particular of at least 540° C. and optionally of at least 560° C. and/or a temperature of at most 700° C., in particular of at most 650° C. and optionally of at most 620° C. In other words, the temperature of the zinc melt can be selected in such a way that high-temperature galvanization is carried out. The zinc melt can thus be referred to as high-temperature zinc melt.

According to the invention, the heat required to produce the zinc melt and/or to maintain or increase its temperature can be supplied by gas burners which can, for example, be directed onto a surface of the zinc melt.

In other embodiments, fuel rods or other heating elements arranged in the boiler may be provided. The boiler can also have at least one wall with integrated heating elements, which are accommodated in particular in shaped slots, protrusions, radiators, rods, etc. The heating elements can be heated electrically, with gas, inductively or by other means. This means that heat can also be supplied from below and/or from the side of the boiler.

According to the invention, the heat required to produce the zinc melt and/or to maintain or increase its temperature can be supplied by means of inductive heating. For this purpose, an inductive heating device can be used through which the zinc melt can flow. For example, the zinc melt is pumped continuously or intermittently through the inductive heating device, whereby heat can be supplied to it in the heating device. As an alternative or in addition, a heating device can be used that the entire boiler with heat. For example, inductive loops can be routed around the boiler. Optionally, a device can be provided that moves the zinc melt in the boiler, for example by stirring, circulating or pumping it around.

As mentioned, the galvanization layer can comprise one or more iron-zinc phases. The galvanization layer can have a similar or identical composition to the galvanization melt or correspond to its alloy. The galvanization layer may further comprise an essentially pure zinc layer, which may occur in particular in the case of very thin components.

It is understood that the dipping of the ferrous material parts can be preceded by steps for surface treatment or other preparation of the ferrous material parts. This can comprise, for example, attaching and/or hanging on a beam and/or a crossbar, adding to a dipping container, feeding into a feed system, etc. In addition, a step for degreasing the ferrous material parts may be provided. Furthermore, according to the invention, it may be provided that the ferrous material parts are rinsed and/or pickled before being dipped into the zinc melt. They can also be dipped into a flux bath. In this context, the term "dipped" also comprises both moving in/dipping and then pulling out as well as continuously moving through. It is further possible that the ferrous material parts are dried before being dipped into the zinc melt, for example in a drying oven. Spraying would also be conceivable, preferably as long as the components are not hollow and/or shadow formation is essentially excluded. The pre-treatment can comply with various specifications, such as the guideline "DASt-Richtlinie 022" of the German Association of Constructional Steelwork (Deutscher Ausschuss für Stahlbau) or regulations issued by end customers such as the DBL.

Pre-treatment with a blasting system and/or laser treatment would also be conceivable. Other options for achieving a metallically pure surface would also be possible according to the invention.

It is further understood that the method can include further steps after dipping. This can, for example, involve moving the ferrous material parts out of, in particular pulling them out of or lifting them out of, the zinc melt. In the process, zinc can run off the ferrous material parts. It should be noted that the processes described above, in which iron is lost from the ferrous material part into the galvanization layer and from the galvanization layer into the zinc melt, can still take place even after the ferrous material parts have been removed from the zinc melt, especially as long as there are still residues of the iron-undersaturated zinc melt on the ferrous material parts. This process can also depend on the heat stored in the ferrous material parts and any beams, which influences the cooling rate of the removed ferrous material parts. The amount of heat stored depends, for example, largely on the material thickness or the mass of the ferrous material parts and possibly the beams. It is also conceivable that ferrous material parts are dipped primarily in order to increase the heat capacity and thus promote growth through the layer and the corresponding prior flow-off.

Furthermore, after or during removal from the zinc melt, a method step can be provided for removing residues of the zinc melt from the ferrous material parts. This may comprise rinsing, blowing off, shaking, brushing, etc.

In general, the removal of the ferrous material parts from the zinc melt can be followed by cooling of the ferrous material parts, in particular cooling in air and/or by dipping into a cooling bath, for example a water bath. Subsequent post-treatment of the components to achieve additional surface properties, such as chromatizing or passivating, can also be part of it. As an alternative to the dipping process, spraying or coating would be possible as well.

According to one embodiment of the invention, the iron-undersaturated zinc melt is not in equilibrium with respect to its iron concentration. In other words, according to the invention, the iron-undersaturated zinc melt tends to move towards an iron-saturated state under the conditions prevailing during the method. The undersaturation can be a transient state. This makes it possible to work with highly efficient timing in a controlled manner by utilizing the fact that the zinc melt is in the undersaturated state for a sufficient but not permanent time period. Thus, it can be avoided to wait for a long period of time until the zinc melt has completely reached equilibrium. Instead, establishing the undersaturation can be associated with leaving the equilibrium, and dipping the ferrous material parts can take place immediately and shortly after establishing the undersaturation without having to wait until a new state of equilibrium is achieved.

This highly efficient timing can generally be achieved in particular if the iron-undersaturated zinc melt is only temporarily iron-undersaturated, so that the zinc melt moves back to an iron-saturated state or at least towards an iron-saturated state by itself after the ferrous material parts have been dipped into the iron-undersaturated zinc melt, or if this has the tendency to move back to an iron-saturated state or at least towards an iron-saturated state by itself. In other words, the undersaturation of the iron concentration can only be established temporarily, for example for the dipping period of the ferrous material parts or for a period of time which is at most 10 times, at most 5 times or even at most 2 times as long as the dipping period. In some embodiments, it may be provided that the undersaturation is essentially kept constant, whereby this may involve actively influencing the zinc melt, in particular to prevent it from moving back towards the iron-saturated state on its own. At the same time, this state can quickly be reversed as well, as without additional heating of the zinc melt, dipping the material at a temperature lower than that of the zinc melt removes energy and thus the temperature drops again quickly. This means that the undersaturated state can be reversed quickly.

In particular, a desired layer thickness can be reliably adjusted if the method further comprises the following steps: measuring a thickness of the galvanization layer formed due to dipping it in the iron-undersaturated zinc melt; comparing the measured layer thickness with a threshold value, in particular to a first threshold value; and increasing the undersaturation of the iron concentration of the zinc melt so that it is more iron-undersaturated if the measured layer thickness exceeds said threshold value. As an alternative or in addition, the method may comprise the following steps: measuring a layer thickness of the galvanization layer formed due to dipping it in the iron-undersaturated zinc melt; comparing the measured layer thickness with a threshold value, in particular to second threshold value; and reducing the undersaturation of the iron concentration of the zinc melt so that it is less strongly iron-undersaturated if the measured layer thickness falls below this threshold value. Consequently, two threshold values can be selected as well, an upper and a lower or a first and a second threshold value, which can define a target interval. If the measured layer thickness is outside this target interval or exceeds or falls below the corresponding threshold value, the undersaturation can be adjusted. As the layer thickness can be adjusted via the undersaturation, as mentioned above, and is largely independent of the dipping time, this makes it possible to react to deviations from a target layer thickness during operation. This means that a layer thickness that meets the desired specifications can often be achieved during the next galvanization cycle. In addition, the method according to the invention has the advantage that, due to the high temperatures of the zinc melt, the dependency on the steel alloy of the ferrous material parts is very low or negligible. Patchwork components can therefore be coated in a controlled and uniform manner as well. For this reason, it is further possible to use zinc melt that contain a significant amount of foreign metals, such as tin, nickel or aluminum.

According to further embodiments of the invention, the method comprises several galvanization processes which are carried out in temporal succession. After galvanization in the iron-undersaturated zinc melt, in which, for example, thin galvanization layers are produced, the iron concentration of the zinc melt can be saturated again or for the first time.

Subsequently, a further galvanization process can be carried out in the iron-saturated zinc melt, for example with other ferrous material parts that are to be coated with a comparatively thicker galvanization layer. In other words, once undersaturation has been achieved, the zinc melt can be reverted to its equilibrium state, which may include iron saturation of the zinc melt.

In general, the method can further include saturating the iron concentration of the zinc melt, in particular saturating it again, so that it is saturated with iron again or for the first time. The method can also include dipping further ferrous material parts into the now iron-saturated zinc melt, whereby a galvanization layer is formed on the further ferrous material parts. The method can further include establishing an undersaturation of the iron concentration of the zinc melt so that it is again iron-undersaturated. The method can also comprise dipping further ferrous material parts into the now again iron-undersaturated zinc melt, whereby a galvanization layer is formed on the further ferrous material parts. According to the invention, several galvanization cycles can therefore be carried out. It is also understood that several galvanization cycles can be carried out in succession in the iron-undersaturated zinc melt and/or several galvanization cycles can be carried out in succession in the iron-saturated zinc melt.

In many cases, it can be useful to combine the galvanization processes in the production schedule according to their layer thickness requirements, so that relatively few temperature changes are required and thus galvanization is comparatively continuous. As components and steel grades/ ferrous materials, including their thickness ratios, can differ slightly in their galvanization behavior, these can be planned accordingly in order to achieve the respective layer thickness specifications with as little changes as possible.

Furthermore, it may be provided that the temperature of the zinc melt is lowered between some or all of the steps mentioned. Thus, the temperature can be lowered to a degree at which iron and/or hard zinc precipitates.

Any precipitated products can be removed from the zinc melt before the next galvanization cycle is started or before the temperature of the zinc melt is increased again.

In particular, an undersaturation can be specifically adjusted to a desired level if the production of undersaturation of the iron concentration of the zinc melt involves a reduction in the iron concentration. The undersaturation can generally be achieved by the intentional addition of zinc. By adding additional zinc to the zinc melt, the proportion of zinc is increased, while the proportions of other materials, in particular the proportion of iron, are reduced. The intentional addition of zinc can be accompanied by a removal of zinc melt and/or a removal of hard zinc so that their total mass remains essentially unchanged. The iron content can therefore be reduced without significantly changing the mass and volume of the zinc melt and therefore the filling level of the boiler. As an alternative or in addition, an intentional removal of iron can be intended, which can also reduce the iron concentration.

According to a further embodiment of the invention, in order to reduce the iron concentration, at least one iron-binding device is brought into contact with the zinc melt, which selectively binds iron from the zinc melt. The iron-binding device can be formed on and/or in the boiler. The iron-binding device can be moved into the zinc melt and removed from the zinc melt. As an alternative or in addition, the zinc melt can flow through the iron-binding device. For example, access to the iron-binding device can be selectively opened, through which the zinc melt can flow into the iron-binding device to establish the undersaturation. Preferably, the iron-binding device has at least one iron-binding unit, the surface of which selectively binds iron from the zinc melt. The iron-binding unit can have a structured, in particular a microstructured, surface. This means that a large surface area can be provided in a comparatively small space, allowing iron to be effectively removed from the zinc melt. The iron-binding unit can be designed in the manner of a filter and/or in the manner of a membrane. The iron-binding unit can be designed to bind iron electrochemically and/or chemically. For example, the iron-binding unit can comprise a material that is iron-deficient, such as a crystal with corresponding defects. If this material comes into contact with the iron from the zinc melt, iron can be selectively incorporated into the material. As a result, the iron concentration of the zinc melt is reduced, causing it to enter an undersaturated state.

The thickness of the galvanization layer can easily be adjusted and the need for adjusting the composition of the zinc melt can be avoided if the iron concentration is essentially constant when the undersaturation of the iron concentration of the zinc melt is established. This can mean that the iron concentration changes by a maximum of 10%, in particular by a maximum of 5%, preferably by a maximum of 1% and in particular preferably by a maximum of 0.5%, relative to the iron concentration before the production of the undersaturation or during or after the step of saturating the iron concentration.

It may be provided that an iron saturation concentration of the zinc melt is changed when the undersaturation of the iron concentration is established. Hereby, an undersaturation can still be established, particularly if the iron concentration is essentially constant. Thus, it is not absolutely necessary to change the composition of the zinc melt in order to achieve an iron-undersaturated state. Changing the iron saturation concentration comprises, in particular, increasing the iron saturation concentration. As a result, after changing the iron saturation concentration, the iron concentration of the zinc melt is below the new iron saturation concentration, i.e. the zinc melt is iron-undersaturated.

A reliably controllable and/or easily manageable approach to establish the undersaturation of the iron concentration may involve increasing a temperature of the zinc melt. By increasing the temperature in a targeted manner, the iron saturation concentration can be increased. The iron concentration present before the undersaturation is established is then lower than the new iron saturation concentration. In particular, it is intended that the temperature increase takes place within a period of time that is less than the period of time required for the zinc melt to return to an iron-saturated state by itself with respect to the increased iron saturation concentration. As explained above, iron loss from the ferrous material parts, the beams, accumulated hard zinc that has settled in the zinc melt, etc. can cause the iron concentration of the zinc melt to increase by itself as soon as it is iron-undersaturated. By selecting the rate of shift in the iron saturation concentration to be higher than the rate of increase in the iron concentration, an iron-undersaturated zinc melt can be obtained, at least temporarily.

In other words, increasing the temperature of the zinc melt can occur faster than a post-saturation of the zinc melt with iron following the temperature increase, so that the iron concentration, due to the temperature increase, deviates at least temporarily from an iron saturation concentration of the zinc melt with increased temperature.

The temperature of the zinc melt can be increased in stages. In particular, several different target temperatures of the zinc melt can be adjusted in succession. With several different target temperatures of the zinc melt, ferrous material parts can be dipped into the zinc melt in order to form a galvanization layer on them. This allows several galvanization cycles to be carried out in a time and cost-efficient manner, whereby the iron-undersaturated zinc melt can be used for layering multiple times. The step-by-step increase allows the zinc melt to be repeatedly brought out of equilibrium in terms of its iron concentration by creating a gap between the iron concentration and the iron saturation concentration.

As an alternative or in addition, the temperature can also be increased continuously, whereby, for example, the distance between the iron concentration and the iron saturation concentration can be kept essentially constant. For example, the temperature can initially be increased abruptly by a few K in order to establish a certain level of iron undersaturation. This can define an initial step-like temperature increase. The temperature can then be further increased in smaller steps and/or continuously in order to raise the iron saturation concentration in parallel with an increasing iron concentration. In particular, this parallel increase may involve that the gap between the iron concentration and the iron saturation concentration remains essentially constant.

If necessary, the temperature of the zinc melt can be reduced temporarily. This can cause the loss of the iron because the iron saturation concentration decreases due to the temperature reduction. The iron concentration is then above the iron saturation concentration, which can lead to the loss of iron. In this case, hard zinc can be formed, which can settle at the bottom of the boiler or at the bottom of the zinc melt. This is due to the higher specific weight of the hard zinc. If necessary, the hard zinc can be removed from the zinc melt. Thus, iron can be removed from the system, which could otherwise contribute to an increase in the iron concentration once the zinc melt is undersaturated, because iron from the hard zinc would enter the undersaturated zinc melt.

In some embodiments, increasing the temperature of the zinc melt comprises a temperature change of at least 3 K, in particular of at least 4 K and optionally of at least 5 K and/or a temperature change of at most 15 K, in particular of at most 10 K and optionally of at most 7 K. Larger and/or smaller temperature changes can be used as well. In general, temperature changes which are expedient for the temporary generation of an undersaturation are possible according to the invention. Depending on the expected increase of the iron concentration of the undersaturated zinc melt, which depends, for example, on the total mass of ferrous parts/products/materials in contact with the zinc melt, other temperature changes may be expedient, whereby larger and/or more rapidly induced temperature changes may be advantageous for more rapidly expected increases.

Galvanization layers of high quality can be produced economically in particular if the undersaturation of the iron concentration of the zinc melt is adjusted in such a way that a resulting layer thickness of the galvanization layer formed when the ferrous material parts are dipped into the iron-undersaturated zinc melt is essentially independent of the total dipping duration, at least for total dipping durations which lie between a minimum duration and a maximum duration, the minimum duration and the maximum duration each lying in the order of minutes and differing from one another in the order of minutes. The total dipping duration can be considered to be a period of time between a first contact of the zinc melt by a ferrous material part first touching the zinc melt and a last contact of the zinc melt by a ferrous material part last touching the zinc melt.

This information relates in particular to the zinc melt in the boiler and not to residues of the zinc melt that may still remain on the ferrous material parts after they have been removed from the zinc melt. A minimum value for the minimum duration can be defined by the time it takes for the temperature of the ferrous material parts to reach the temperature of the zinc melt. The minimum duration can further be chosen to be longer than this time in order to ensure that the coating process is stable. For small or thin ferrous material parts such as sheet metal, for example, the temperature adjustment can be completed after just a few seconds. The minimum duration can also be influenced by the time it takes to dip the ferrous material parts into the zinc melt and, if necessary, remove them. It is expedient to select a minimum duration of at least 1 minute, in some embodiments of at least 2 minutes, in further embodiments of at least 3 minutes or even of at least 5 minutes. It is expedient to select a maximum duration of at most 2 minutes, in some embodiments of at most 3 minutes, in further embodiments of at most 5 minutes or even of at most 10 minutes. The maximum duration can be selected to be comparatively low due to the at best low dependence of the thickness of the galvanization layer on the total dipping time. As mentioned above, for long total dipping times in some embodiments, essentially only more iron is released from the ferrous material parts into the zinc melt without the thickness of the galvanization layer being significantly affected. It is expedient to select a maximum duration of at least 3 minutes, in some embodiments of at least 5 minutes, in further embodiments of at least 10 minutes or even of at least 15 minutes. It is expedient to select a maximum duration of at most 5 minutes, in some embodiments of at most 10 minutes, in further embodiments of at most 15 minutes or even of at most 30 minutes. According to the invention, however, even smaller minimum durations, for example in the range of seconds, and/or even larger maximum durations, for example in the range of one or more hours, can be selected as well.

As explained above, the processes that lead to the creation of the galvanization layer can continue even after the ferrous material parts have been removed from the zinc melt, as long as there is still liquid zinc on the ferrous material parts. In addition, due to the temperature adjustment initially required after dipping, it is possible that these processes do not yet take place or do not yet take place at their final rates at the start of the dipping process. The total dipping time may therefore deviate from the total time during which these processes take place.

In some embodiments, a layer thickness of the galvanization layer, which is formed when the ferrous material parts are dipped into the iron-undersaturated zinc melt, is at most 200 μm, at most 150 μm or at most 100 μm but can also be at most 80 μm or even at most 60 μm. The layer thickness can be at least 300 μm, at least 50 μm, at least 80 μm or at least 120 μm. The specified layer thicknesses can relate to flat and/or uniform surfaces of the ferrous material parts on which the layer thickness is essentially free of accumulation effects due to a geometry of the ferrous material parts. It is understood that due to such accumulation effects, for example on internal edges, in small recesses etc., greater layer thicknesses may also occur at certain points. An increase in surface roughness also leads to a thicker zinc layer, just as a very smooth surface leads to a reduction in layer thickness.

This is due to the size of the reactive surface from which the formation of the iron-zinc phases starts.

The invention also relates to a galvanization line comprising a boiler adapted to hold zinc melt, in particular a high-temperature molten mass, and a heating device adapted to supply the boiler with a quantity of heat that is required to produce and maintain the zinc melt, the boiler and the heating device being specially adapted to carry out a method according to the invention.

The galvanization line can comprise a dipping device that is set up to dip ferrous material parts into the boiler. The dipping device can comprise a holding unit to which the ferrous material parts can be attached to for dipping. This may include, for example, hanging and/or tying and/or fastening with wire or the like. The dipping device and in particular the holding unit can comprise at least one beam and/or at least one crossbar. The dipping device can have a drive by means of which the movement necessary for dipping the ferrous material parts can be generated at least partially automatically. For example, the drive can be set up in such a way that it moves the holding unit and/or the at least one beam and/or the at least one crossbar into and/or out of the boiler, for example perpendicular to a surface of the zinc melt. This should also be understood to include processes in which components are pressed into the zinc melt, such as tubular parts that are open at the top and are only to be galvanized on their exterior. This occurs, for example, in the case of heat exchangers.

The heating device can be an inductive heating device. As an alternative or in addition, the heating device may comprise at least one gas burner, at least one fuel rod, at least one resistive heating element or the like. The heating device can be controlled semi-automatically or automatically.

According to one embodiment, the galvanization line comprises a control unit which is set up to control components of the galvanization line for at least partially automated or automated execution of a method according to the invention. In particular, the control unit can be set up to control and/or regulate the temperature of the zinc melt. The control unit can have at least one processor and a computer-readable medium on which a program code is stored that defines at least one function of the control unit. For example, at least one temperature program can be stored in the control unit, which comprises a specific time curve of a target temperature for the zinc melt. The control unit can be set up to control the heating device. A temperature curve according to the temperature program can be run by the heating device, for example. The control unit can further be set up to carry out control and/or regulation of the layer thickness on the basis of at least one layer thickness measurement. A measured layer thickness can be entered, for example via a user interface, by a user after manual measurement. An automated measurement can also be provided according to the invention. For example, the control unit can be set up to adjust the temperature program depending on an actual layer thickness and a target layer thickness, for example to set a greater undersaturation if the layer thickness is too great, to set a lower undersaturation if the layer thickness is too low, or to increase or decrease a dipping time. In principle, a control unit using relays is also possible according to the invention.

The invention further relates to a control unit of the described type. In addition, the invention may comprise a computer-readable medium on which program code is stored which, when executed by a computer, is adapted to effect at least partially automated execution of at least one of the described method steps, in particular by controlling corresponding components of the galvanization line according to the invention.

In addition, the invention includes such a program code.

Figure 2:
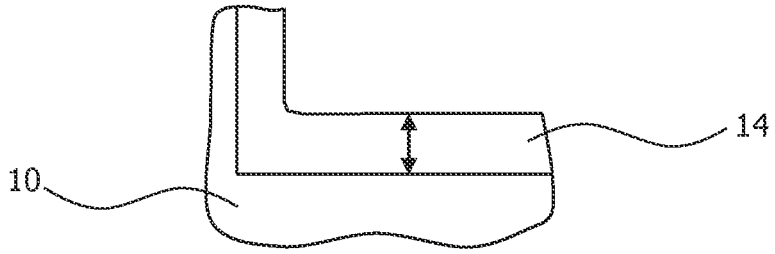
Figure 3:
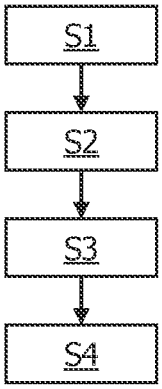
Figure 4:
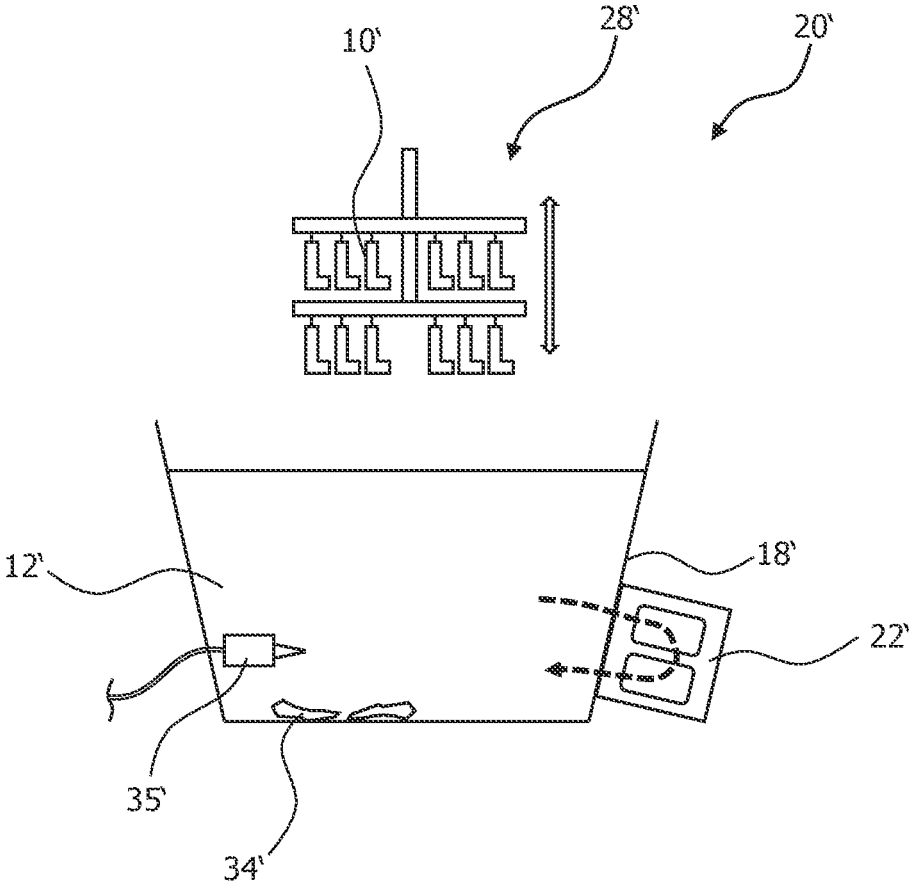
Figure 5:
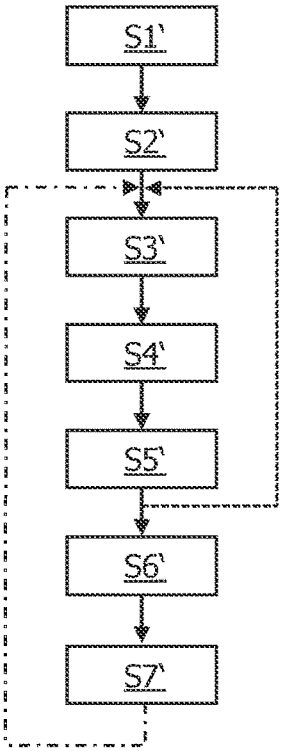
Figure 6:
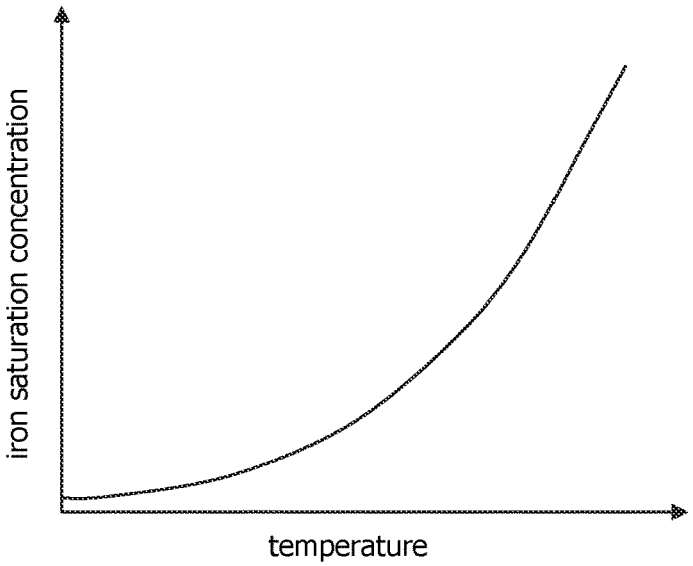
Figure 7:
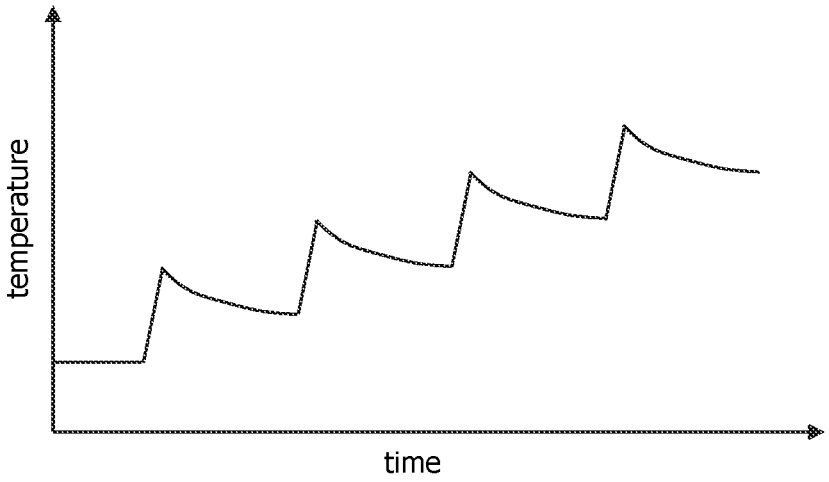
Figure 8:
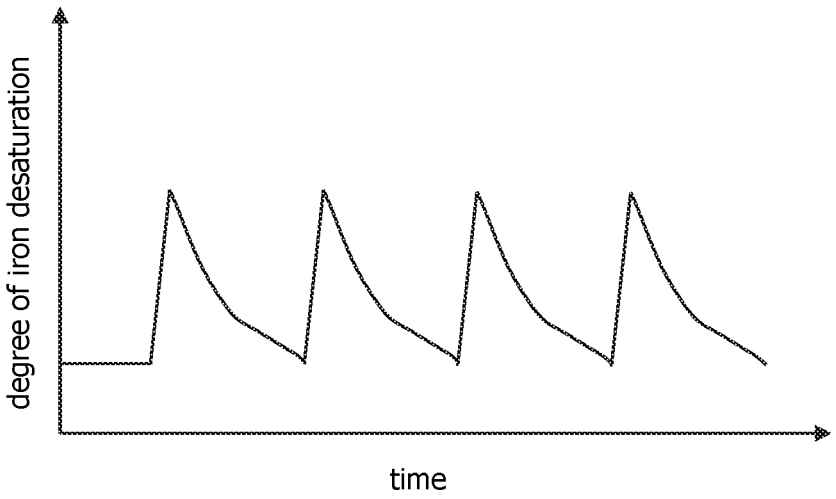
Figure 9:
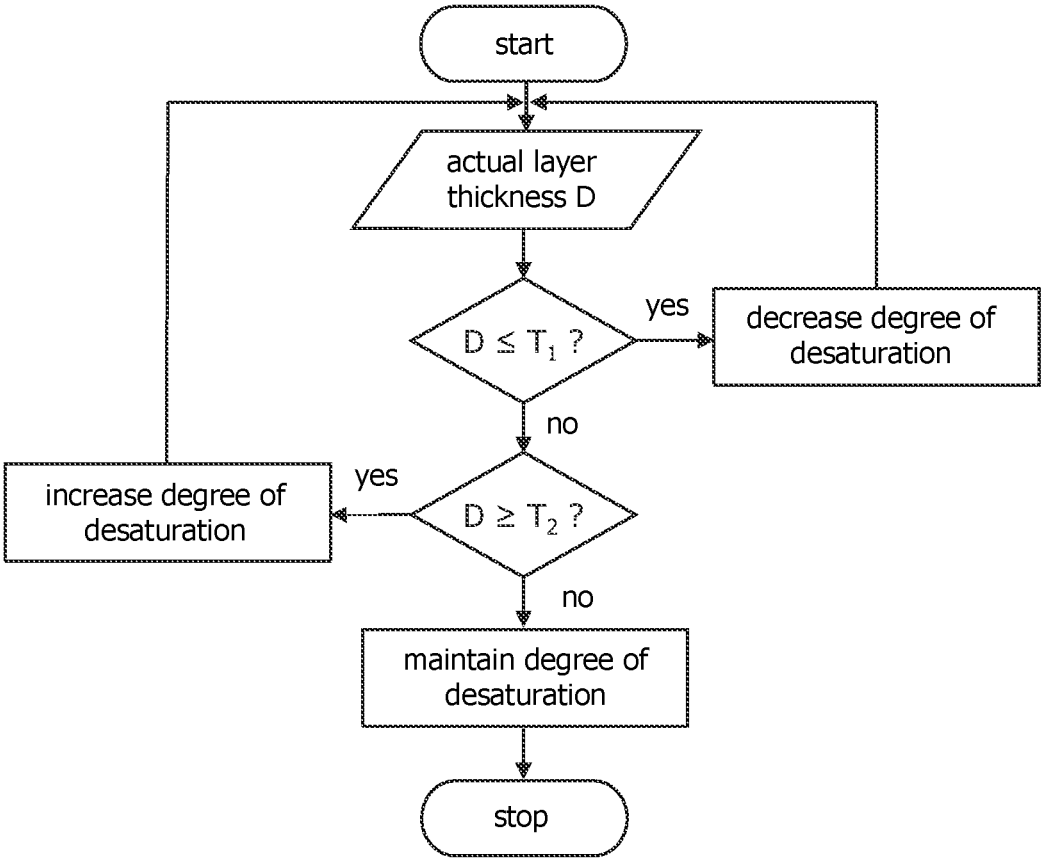
Figure 10:
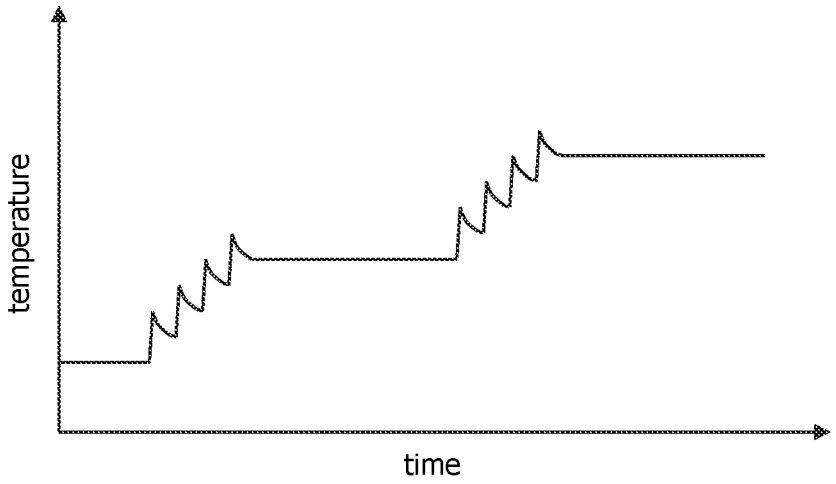
Figure 11:
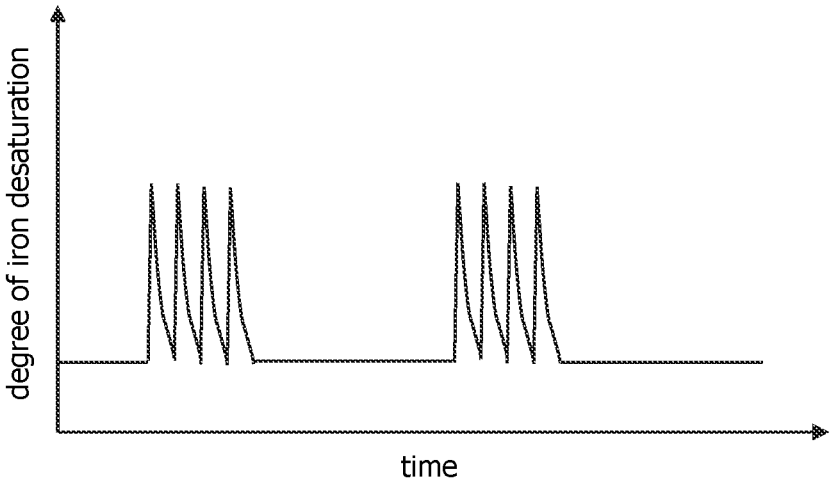
Figure 12:
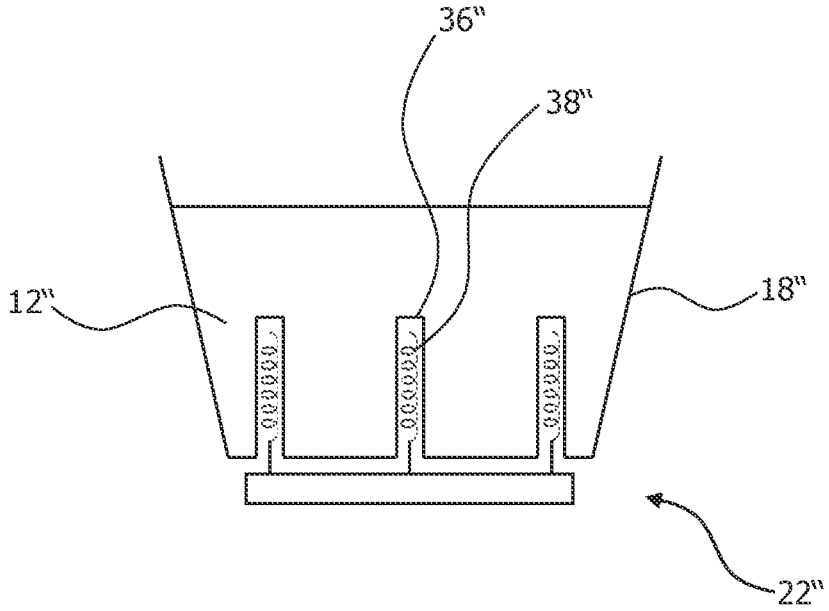
Figure 13:
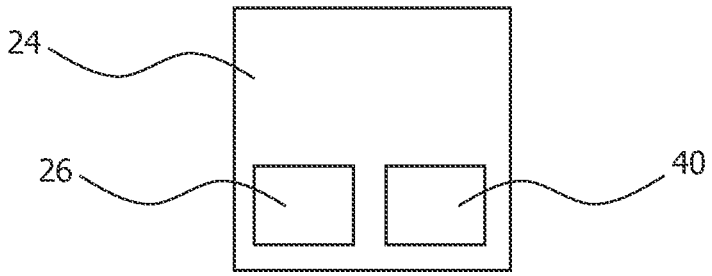

Subsequently, the present invention is described by way of example with reference to the attached figures. The drawing, the description and the claims contain numerous features in combination. The skilled person will expediently consider the features individually as well and use them sensibly in combination within the scope of the claims. It shows a:

FIG. 1 schematic representation of a galvanization line;

FIG. 2 schematic representation of a section of a galvanized ferrous material part;

FIG. 3 schematic flow chart of a method for high-temperature galvanization of ferrous material parts;

FIG. 4 schematic representation of an alternative galvanization line;

FIG. 5 schematic flow chart of an alternative method for high-temperature galvanization of ferrous material parts;

FIG. 6 schematic diagram illustrating the relation between a temperature of zinc melt and an iron saturation concentration of the zinc melt;

FIG. 7 schematic diagram illustrating a temperature curve of zinc melt over time during the method;

FIG. 8 schematic diagram illustrating a time curve of a degree of iron desaturation during the method;

FIG. 9 schematic flow chart illustrating the procedure for measuring a layer thickness;

FIG. 10 schematic diagram illustrating a temperature curve of zinc melt over time during a longer period of the method;

FIG. 11 schematic diagram illustrating a time curve of a degree of iron desaturation during a longer period of the method;

FIG. 12 schematic representation of another alternative galvanization line; and FIG. 13 schematic representation of a control unit for a galvanization line.

FIG. 1 shows a galvanization line 20. This comprises a ceramic boiler 18, which is set up to hold a zinc melt 12. The galvanization line 20 is set up to carry out high-temperature galvanization.

The galvanization line 20 comprises a dipping device 28 with a holding unit 30 to which the ferrous material parts 10 that are to be galvanized are attached. In the present case, the holding unit 30 has several beams on which the ferrous material parts 10 are suspended. The dipping device 28 is designed to lower and raise the holding unit 30, whereby the ferrous material parts 10 can be dipped into the zinc melt 12 for galvanization and removed from it again.

The galvanization line 20 further comprises a heating device 22, which is only shown schematically. In the exemplary embodiment according to FIG. 1, the heating device 22 comprises one or more gas burners which are directed onto a surface of the zinc melt 12. Heat can be supplied to the zinc melt 12 by means of these gas burners.

The zinc melt 12 is a high-temperature zinc melt and has a temperature of, for example, 580° C. during operation. In the present case, the temperature can be adjusted by suitably controlling the heating device 22. If necessary, the temperature of the zinc melt 12 can be changed.

In general, in the embodiments of the invention, zinc melt with a zinc content of at least 90%, in some cases at least 95% or even at least 98% can be used. The zinc melt can be in accordance with DIN EN ISO 1461, DASt 022 or also specific requirements of customers and/or associations.

FIG. 2 shows a schematic representation of a ferrous material part 10 that has already been galvanized. A galvanization layer 14 is present on the ferrous material part 10, which was formed during galvanization in the zinc melt 12. At the point marked with a double arrow, the galvanization layer 14 has a layer thickness of approximately 50 μm, whereby this value is to be understood as purely exemplary. Depending on the ferrous material part, expected requirements, customer-specific wishes etc., other layer thicknesses can be selected.

The layer thickness of the galvanization layer 16 is very homogeneous due to the favorable flow behavior of the zinc during high-temperature galvanization and there are only slight accumulation effects at internal edges, recesses, in threads, etc. at most. The specified layer thickness is therefore to be understood as the general layer thickness of the galvanization layer 14, but in the case shown it nevertheless refers to a flat and/or uniform surface of the ferrous material part 10, on which the layer thickness is essentially free of such accumulation effects. The zinc is only limited in its flow in "pots" or on larger unevennesses, such as weldseams that have not been leveled or burrs from previous processing steps and corresponding deviations in the zinc layer thickness can occur.

FIG. 3 shows a schematic flow chart of a method for high-temperature galvanization of the ferrous material parts 10. The method can be carried out using the galvanization line 20.

In a first step S1, the zinc melt 12 is produced. Zinc and, if necessary, additives are melted. In a second step S2, the iron concentration of the zinc melt 12 is saturated so that it is iron-saturated.

For this purpose, pure iron or ferrous zinc is added to the zinc melt 12 as required. This can be done, for example, until hard zinc begins to precipitate or the added iron no longer migrates into the zinc melt. It should be noted that the melting point of iron is more than 1,000 K higher than that of zinc, so iron only enters the zinc melt up to its saturation concentration, but no liquid alloy is formed, as can be the case for alloys whose temperature exceeds the melting points of all components, provided the different metals do not separate due to differing densities.

Subsequently, in step S3, an undersaturation of the iron concentration is established so that the zinc melt 12 is iron-undersaturated. In the embodiment according to FIG. 1, the galvanization line 20 has an iron-binding device 16, which is optionally brought into contact with the zinc melt for this purpose. The iron-binding device 16 comprises an iron-binding unit 32. This can, for example, be arranged in a housing, the interior of which can optionally be brought into contact with the zinc melt 12, for example by motorized lifting of a wall and/or a base of the boiler 18. As an alternative, it can also be provided that zinc melt 12 is passed through and/or pumped through the iron-binding device 16 and thereby comes into contact with the iron-binding unit 32.

The iron-binding unit 32 has an iron-binding material that forms a large surface area. This is only indicated schematically in FIG. 1.

Preferably, the iron-binding material is structured, in particular microstructured, and thus has a greatly increased surface area on which large quantities of iron can be deposited.

By bringing the iron-binding device 16 into contact with the zinc melt 12, iron is removed from the zinc melt 12 and thus the iron concentration of the zinc melt is reduced. Thus, the iron concentration is lower than the iron saturation concentration, which serves as a starting point for initiating step S3. The zinc melt 12 is therefore iron-undersaturated.

The degree of undersaturation can be adjusted by controlling the contact of the zinc melt with the iron-binding device 16. For this purpose, a contact duration, a flow rate, a surface of the iron-binding unit 32 brought into contact, or the like can be varied.

Referencing FIG. 3 again, the method further comprises step S4 in which the ferrous material parts 10 are dipped into the iron-undersaturated zinc melt 12, whereby a galvanization layer 14 (cf. FIG. 2) is formed on the ferrous material parts 10.

The formation of the galvanization layer is thus determined by the two aforementioned processes: the loss of iron from the corresponding ferrous material part 10 into its growing galvanization layer 14 as well as the loss of iron from the growing galvanization layer 14 into the zinc melt 12. Depending on the selected undersaturation, these processes can take place at essentially the same rate, making the resulting layer thickness largely independent of the dipping time of the ferrous material parts 10.

Optionally, the method comprises pre-treatment steps that are carried out before dipping the ferrous material parts 10. This may be carried out in parallel with steps S2 and S3.

Optionally, the method further comprises another step in which the ferrous material parts 10 are removed from the zinc melt 12 after a predetermined dipping time. The galvanized ferrous material parts 10 can be cooled after dipping. Chromatization and/or passivation may also be provided. In addition, various post-treatment steps may be provided, for example for removing the ferrous material parts 10 from the holding unit 30 and/or for polishing and/or grinding the galvanized ferrous material parts 10.

FIG. 4 shows an alternative galvanization line 20'. Analogously to the galvanization line 20 according to FIG. 1, the alternative galvanization line 20' has a ceramic boiler 18', which holds zinc melt 12'. It further contains a dipping device 28' to which the ferrous material parts 10' that are to be galvanized are attached. In this regard, reference is made to the description of the dipping device 28 in FIG. 1.

The alternative galvanization line 20' has an inductive heating device 22'. In the case shown, the heating device 22' is attached to the side of the boiler 18 and the zinc melt 12 can flow through it. Heat is thus supplied inductively to the zinc melt 12 within the heating device 22'. The inductive heating used enables a very homogeneous temperature distribution to be achieved in the zinc melt 12.

The alternative galvanization line 20' further comprises a temperature measuring unit 35'. The temperature measuring unit 35' may comprise and/or be configured as one or more thermocouples, as well as another type of suitable temperature sensor. The temperature measuring unit 35' may comprise a protective housing for the thermocouples and/or temperature sensors, which preferably continuously send a signal to a control unit of the galvanization line 20' (cf. FIG. 13). In the present embodiment, the temperature measuring unit 35' expediently comprises at least two thermocouples so that they can monitor each other and trigger an alarm or stop the heating in the event of corresponding deviations. The same applies when defined process limits are reached.

It is understood that a corresponding temperature measuring unit can also be provided in the embodiment according to FIG. 1. FIG. 5 shows a schematic flow chart of an alternative method for the high-temperature galvanization of ferrous material parts 10'. This method can be carried out using the alternative galvanization line 20'.

Similar to the method described above, the alternative method also comprises step S1' in which the zinc melt 12' is produced, step S2' in which the iron concentration of the zinc melt is saturated, step S3' in which an iron undersaturation is established, and step S4' in which the ferrous material parts 10' are dipped into the iron-undersaturated zinc melt 12', whereby a galvanization layer is formed on the ferrous material parts 10'.

However, there are differences to the method described above with regard to the way in which the undersaturation is achieved in step S3. This emerges from the following description, whereby it is expressly pointed out that the mere mention of a fact does not mean that it must differ from the aforementioned method.

According to the alternative method, the iron-undersaturated zinc melt 12' is not in equilibrium with regard to its iron concentration. Instead, it is only temporarily iron-undersaturated. In the present case, this is controlled via the temperature of the zinc melt 12'.

For a better understanding, the relationship between the temperature of a zinc melt and its iron saturation concentration is shown schematically in FIG. 6. Specific numerical values are not important for the basic principle, which is why the axes of the diagram are shown without units. The decisive factor is that the iron saturation concentration also increases with increasing temperature. The hotter the zinc melt, the more iron it can consequently absorb.

For explanation, reference is made below to FIG. 7 and FIG. 8. The time axes of the two schematic diagrams shown correspond to each other.

According to the alternative method, the temperature of the iron-saturated zinc melt 12' is increased comparatively erratic. This corresponds to the first steep slope of the temperature curve in FIG. 7, for example, starting from a temperature of 550° C. for the zinc melt. As shown in FIG. 8, this rise in temperature leads to an undersaturation of the iron concentration of the zinc melt 12'. For this, we refer once more to the relation shown in FIG. 6. While the iron concentration is essentially constant, this iron concentration essentially corresponds to the saturation concentration before the temperature increase but is significantly lower after the temperature increase. Hereby the degree of desaturation of the zinc melt 12' is increased, as can be seen in FIG. 8.

In the case shown, the temperature is increased by 5 K by way of example. However, other values are also conceivable, as described above. In general, the temperature increase can be selected in such a way that the iron concentration after the temperature increase is a few percentage points below the new iron saturation concentration.

The ferrous material parts 10' can now be dipped into the iron-undersaturated zinc melt 12' (step S4'). The total dipping time is 10 minutes, for example. Within the total dipping time, the temperature of the ferrous material parts 10' first adjusts to the temperature of the zinc melt 12'. Subsequently, the aforementioned processes begin to take place at an approximately constant rate during the formation of the galvanization layer. The galvanization layer can then form in the manner described largely independently of the dipping time. A correspondingly galvanized ferrous material part 10' will correspond approximately to the ferrous material part 10 shown in FIG. 2.

As shown in FIG. 7, the temperature can slightly drop after the increase.

Depending on how the temperature of the zinc melt 12' is controlled and/or regulated, this effect can vary in intensity. However, a falling temperature is always accompanied by a falling iron saturation concentration (see FIG. 6), which leads to a falling degree of desaturation.

Another effect that can lead to a decreasing degree of desaturation is the loss of iron from the ferrous material parts 10' and, if applicable, from the dipping device 28' into the zinc melt 12'. Any hard zinc can also contribute. Iron that enters the zinc melt 12' in a saturated or oversaturated state forms iron-zinc crystals with zinc of the zinc melt 12', which settle at the bottom of the boiler 18 due to their higher density than hard zinc. In the undersaturated state of the zinc melt 12', iron from the hard zinc enters the zinc melt 12', gradually increasing its iron concentration. This effect is superimposed on the effect of a slight drop in temperature. Even if the temperature is kept completely constant after it has been increased, the degree of desaturation will gradually decrease due to this loss of iron or the introduction of iron from the hard zinc, and the zinc melt 12' will consequently move towards its iron saturation concentration. It is therefore important for the alternative method that the temperature increase takes place more quickly than a re-saturation of the zinc melt 12'.

After the desired total dipping time has elapsed, the ferrous material parts 10' are removed from the zinc melt 12'. Step S5' can be provided for this purpose.

A further method step can then follow, in which the temperature of the zinc melt 12' is rapidly increased again. As a result, the degree of iron desaturation increases again and further ferrous material parts 10' can be galvanized. FIG. 7 and FIG. 8 show several of such galvanization cycles, each of which includes galvanization in the temporarily iron-undersaturated zinc melt 12'. Accordingly, steps S3' to S5' can be carried out several times, if necessary, as indicated by the dashed arrow in FIG. 5. This means that several galvanization processes take place consecutively in iron-undersaturated zinc melt, whereby the temperature is gradually increased so that a galvanization process can take place at each stage.

In order to determine a suitable degree of desaturation or a suitable temperature increase, a layer thickness D of the formed galvanized layer 14 can be measured after a galvanization cycle. The relevant procedure is explained with reference to FIG. 9. The flow chart shown can serve as the basis for a regulation or adjustment. The measured layer thickness D is compared with a lower threshold value $T_1$ and/or an upper threshold value $T_2$. If a target layer thickness is 50 μm, for example, the lower threshold value can be 40 μm and the upper threshold value can be 60 μm, although other values are also possible according to the invention. If the measured layer thickness D is below the lower threshold value $T_1$, it can be concluded that the degree of desaturation and thus the loss of iron into the zinc melt during galvanization is too high. It is possible to react to this by using a smaller temperature rise, which in turn results in a comparatively lower degree of desaturation. If, however, the measured layer thickness D is above the upper threshold value $T_2$, it can be concluded that the degree of desaturation and thus the loss of iron into the zinc melt during galvanization is too low. To remedy this, a higher temperature increase can be used in this case, which in turn results in a comparatively higher degree of desaturation.

It is understood that in the case of the method according to FIG. 3 or the control of undersaturation by removing iron from the zinc melt, instead of the aforementioned changes to the temperature increases, an influence of the zinc melt can be changed instead by the iron-binding device. For example, a contact period with the iron-binding device can be increased in order to increase the degree of desaturation, or correspondingly vice versa.

Further optional steps of the alternative method are explained below with reference to FIG. 10 and FIG. 11. In principle, the method can comprise galvanization in iron-undersaturated zinc melt and galvanization in iron-saturated zinc melt. For example, one or more cycles can first be carried out in iron-undersaturated zinc melt, for example as described with reference to FIG. 7 and FIG. 8. Subsequently, one or more cycles can be carried out in iron-saturated zinc melt, for example in order to galvanize other ferrous material parts with thicker layers, for which precise layer thickness control may not be necessary.

The method can accordingly include step S6' (see FIG. 5), in which the iron concentration of the zinc melt is saturated once more. For this purpose, for example, after a final galvanization in iron-undersaturated zinc melt, there is a longer waiting period and, if necessary, iron is added until the zinc melt is no longer iron-undersaturated. This may also involve leveling the temperature. In FIG. 11, this state corresponds to the long unchanged process after the first peaks in the degree of iron desaturation or the first multi-stage temperature increase.

In a step S7', further ferrous material parts 10 can be dipped into the now iron-saturated zinc melt. It is then galvanized in the conventional manner, meaning without iron undersaturation. Step S7' can include several dipping processes while the zinc melt is essentially unchanged.

Subsequently, an iron undersaturation can be established once more in order to galvanize ferrous material parts in iron-undersaturated zinc melt.

Accordingly, the method can return to step S3' and be carried out up to step S7' several times. This is shown in FIG. 5 by a dot-dashed arrow.

It is also understood that the methods described may comprise one or more galvanization processes in the iron-saturated zinc melt even before they are initially galvanized in the iron-undersaturated zinc melt.

At a suitable point during or after carrying out the method according to the invention, the temperature of the zinc melt 12' can be temporarily reduced in a targeted manner. This reduces the iron saturation concentration to such an extent that a current iron concentration of the zinc melt exceeds the new iron saturation concentration. This causes iron to precipitate. Hard zinc 34' is formed, which is shown schematically in FIG. 4. Due to its higher specific weight, the hard zinc 34' sinks in the zinc melt 12'. It can then be extracted, whereby iron is removed from the system. The temperature of the zinc melt 12' is then increased again and further galvanization can be carried out in iron-saturated and/or iron-undersaturated zinc melt. This can mean that the method schematically illustrated in FIG. 5 can start again from the beginning.

A further alternative galvanization line 20" is shown in FIG. 12, which also has a boiler 18" that holds zinc melt 12". The methods described are also shown in the case of the further alternative galvanization line 20". It can basically be designed in the same manner as galvanization line 20 or alternative galvanization line 20'. Corresponding further units and devices are omitted in FIG. 12 and only the differences between this embodiment and the other embodiments are described below.

The further alternative galvanization line 20" has a heating device 22", which comprises a number of fuel rods 36". These protrude into the boiler 18", whereby a uniform heat input can be achieved. Ferrous material parts can be, for example, dipped between and/or above the fuel rods 36".

In general, the heating rods can be introduced into the zinc melt from above or, as shown, from below. Heating elements 38", which are illustrated as spirals in FIG. 12, can be arranged in the heating rods 36" respectively. These can be gas burners, inductive heating elements, resistive heating elements, etc.

FIG. 13 schematically depicts a control unit 24, which is set up to control the described galvanization lines 20, 20', 20". The control unit 24 comprises a computer-readable medium 26 as well as a processor 40 and possibly other required electronic components such as a working memory, connections, lines, etc. The control unit 24 can also be set up to control a user interface via which a user can, for example, enter a target temperature, a predetermined temperature curve, layer thickness thresholds, measured layer thicknesses and the like.

The computer-readable medium 26 includes program code that implements the semi-automated and, in some embodiments, automated performance of one or all of the described methods.

The invention claimed is:

1. A method for high-temperature batch galvanization of ferrous material parts, comprising:

generating a zinc melt, wherein the zinc melt has a temperature of at least 500° C.;

saturating an iron concentration of the zinc melt so that it is iron-saturated;

increasing the temperature of the zinc melt to a series of consecutive target temperatures; and at each target temperature in the series of consecutive target temperatures:

(i) establishing an undersaturation of the iron concentration of the zinc melt so that it is iron-undersaturated; and (ii) dipping a respective batch of ferrous material parts into the iron-undersaturated zinc melt, wherein a respective galvanization layer is formed on the respective batch of ferrous material parts.

2. A method according to claim 1, wherein increasing the temperature of the zinc melt to each target temperature in the series of target temperatures is faster than re-saturating the zinc melt with iron after the temperature has been increased, so that the iron concentration, at least temporarily, deviates from the iron saturation concentration of the zinc melt with increased temperature after increasing the temperature.

3. A method according to claim 1, wherein increasing the temperature of the zinc melt to the series of consecutive target temperatures repeatedly disequilibrates the zinc melt with regard to its iron concentration by creating a gap between the iron concentration and the iron saturation concentration.

4. A method according to claim 1, wherein the temperature increase of the zinc melt comprises a temperature change of at least 3 K and a temperature change of at most 15 K.

5. A method according to claim 1, wherein the iron-undersaturated zinc melt is not in equilibrium in terms of its iron concentration.

6. A method according to claim 1, wherein the iron-undersaturated zinc melt is only temporarily iron-undersaturated, so that the zinc melt automatically moves back to an iron-saturated state or at least towards an iron-saturated state after each respective batch of the ferrous material parts have been dipped into the iron-undersaturated zinc melt.

7. A method according to claim 1, further comprising:

at each target temperature in the series of consecutive target temperatures:

(i) measuring a thickness of the respective galvanization layer formed due to the dipping into the iron-undersaturated zinc melt;

(ii) comparing the measured thickness of the respective galvanization layer with a threshold value; and (iii) increasing the undersaturation of the iron concentration of the zinc melt so that it is more iron-undersaturated if the measured thickness of the respective galvanization layer exceeds the threshold value.

8. A method according to claim 1, wherein establishing the undersaturation of the iron concentration of the zinc melt comprises a reduction of the iron concentration.

9. A method according to claim 8, wherein at least one iron-binding device, which selectively binds iron from the zinc melt, is brought into contact with the zinc melt in order to reduce the iron concentration.

10. A method according to claim 1, wherein the iron concentration of the undersaturation of the iron concentration of the zinc melt is essentially constant while being established.

11. A method according to claim 1, wherein the iron saturation concentration of the zinc melt is changed when establishing an undersaturation of the iron concentration.

12. A method according to claim 1, wherein the undersaturation of the iron concentration of the zinc melt is adjusted in such a way that, after an initial formation of a respective galvanization layer on each respective batch of the ferrous material parts during dipping the respective batch of ferrous material parts into the zinc melt, a rate at which the respective galvanization layer grows and a rate at which the formed galvanization layer is skimmed essentially correspond.

13. A method according to claim 1, wherein the undersaturation of the iron concentration of the zinc melt is adjusted in such a way that a resulting layer thickness of the respective galvanization layer formed upon dipping each respective batch of the ferrous material parts into the iron-undersaturated zinc melt is, at least for total dipping periods between a minimum period and a maximum period, essentially independent of the total dipping duration, wherein the minimum period and the maximum period are each in an order of minutes and differ from each other in the order of minutes.

14. A method according to claim 1, wherein the zinc melt has a temperature of at least 500° C. and of at most 700° C.

15. A method according to claim 1, wherein heat is supplied to the zinc melt by means of inductive heating.

16. A method according to claim 1, wherein the zinc melt is generated in a ceramic boiler.

17. A method according to claim 1, wherein a layer thickness of the respective galvanization layer, which is formed when the ferrous material parts are dipped into the iron-undersaturated zinc melt, is at most 200 μm and is at least 30 μm on flat and/or uniform surfaces of the ferrous material parts, on which the layer thickness is essentially free of accumulation effects due to a geometry of the respective batch of ferrous material parts.

18. A method according to claim 1, further comprising:

re-saturation of the iron concentration of the zinc melt, so that it is once again iron-saturated;

dipping further ferrous material parts into the once again iron-saturated zinc melt, whereby a galvanization layer is formed on the further ferrous material parts;

re-producing an undersaturation the iron concentration of the zinc melt so that it is again iron-undersaturated; and dipping further ferrous material parts into the now again iron-undersaturated zinc melt, whereby a galvanization layer is formed on the further ferrous material parts.

19. A galvanization line comprising a boiler adapted to accommodate a high-temperature zinc melt and a heating device provided to supply the boiler with an amount of heat required to generate and maintain the high-temperature zinc melt, wherein the boiler and the heating device are specially adapted to perform therewith the method according to claim 1; and a control unit adapted to control components of the galvanization line for an automated execution of the method according to claim 1, wherein the control unit has a temperature program that comprises a certain time line of a target temperature for the high-temperature zinc melt.

20. A computer-readable medium on which program code is stored which is provided for an automated execution of the method according to claim 1 when executed by a computer.

* * * * *